US006752482B2

(12) United States Patent
Fukano et al.

(10) Patent No.: US 6,752,482 B2
(45) Date of Patent: Jun. 22, 2004

(54) DEVICE AND METHOD FOR DRIVING JETTING HEAD

(75) Inventors: Takakazu Fukano, Nagano (JP); Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/356,740

(22) Filed: Feb. 3, 2003

(65) Prior Publication Data

US 2003/0160836 A1 Aug. 28, 2003

(30) Foreign Application Priority Data

Feb. 1, 2002 (JP) ..... P2002-025978
Feb. 27, 2002 (JP) ..... P2002-051596

(51) Int. Cl.[7] ..... B41J 29/38
(52) U.S. Cl. ..... 347/12; 347/11
(58) Field of Search ..... 347/11, 12

(56) References Cited

U.S. PATENT DOCUMENTS 5,265,315 A * 11/1993 Hoisington et al. ..... 29/25.35
2002/0075338 A1 * 6/2002 Kobayashi et al. ..... 347/12
2002/0145637 A1 * 10/2002 Umeda et al. ..... 347/9

FOREIGN PATENT DOCUMENTS

JP 3097155 8/2000

OTHER PUBLICATIONS

Stan Gibilisco, The Illustrated Dictionary of Electronic Terms, 1997, Seventh edition, pp. 364,654.*

* cited by examiner

*Primary Examiner*—Stephen D. Meier
*Assistant Examiner*—Alfred Dudding
(74) *Attorney, Agent, or Firm*—Sughrue Mion, PLLC

(57) ABSTRACT

There is disclosed a head driving device which drives a plurality of pressure generating elements for generating pressure fluctuation in a jetted object contained in each of associated pressure chambers formed in a jetting head of a jetting apparatus to eject the jetted object from each of nozzles communicated with the associated pressure chambers. In the device, a head driver generates a drive signal which is selectively applied to at least one of the pressure generating elements to be driven. A bias potential provider selectively applies a bias potential to at least one of the pressure generating elements not to be driven.

19 Claims, 10 Drawing Sheets

DEVICE AND METHOD FOR DRIVING JETTING HEAD

BACKGROUND OF THE INVENTION

The invention relates to a jetting head capable of ejecting various kinds of liquid in the form of droplets for use in an ink jet printer, a display manufacturing apparatus, an electrode forming apparatus, a biochip manufacturing apparatus, etc., and more particularly, to a jetting apparatus having a plurality of flexible flat cables to be used for supplying drive signals from a head driver to a jetting head.

As a jetting apparatus having a jetting head capable of ejecting liquid in the form of a liquid droplet, for example, there has been proposed an ink jet printer in which ink droplets are ejected to record an image or the like on recording paper, an electrode forming apparatus in which an electrode material in a liquid form is ejected onto a substrate to thereby form electrodes, a biochip manufacturing apparatus in which biological samples are ejected to manufacture biochips, or a micropipette for ejecting a predetermined amount of a sample into a vessel.

For instance, in an ink jet printer employing piezoelectric elements as drive elements for ejecting ink, a plurality of piezoelectric elements, which are provided so as to correspond to a plurality of nozzles of a print head, are selectively activated, whereby ink droplets are ejected from the nozzles in accordance with the dynamic pressure generated by the respective piezoelectric elements. Dots are formed on recording paper by causing the ink droplets to adhere to the recording paper, thus effecting printing operation.

Here, the piezoelectric elements are provided so as to correspond to nozzles to be used for ejecting ink droplets. The piezoelectric elements are actuated by a drive signal supplied from a head driver mounted in the print head, thereby ejecting ink droplets.

SUMMARY OF THE INVENTION

It is therefore an object of the invention to provide a device and a method for driving a jetting head designed to readily retain predetermined bias voltages of respective piezoelectric elements through use of a simple, compact configuration and at low cost.

In order to achieve the above object, according to the invention, there is provided a head driving device, which drives a plurality of pressure generating elements for generating pressure fluctuation in a jetted object contained in each of associated pressure chambers formed in a jetting head of a jetting apparatus to eject the jetted object from each of nozzles communicated with the associated pressure chambers, the head driving device comprising:

- a head driver, which generates a drive signal which is selectively applied to at least one of the pressure generating elements to be driven; and
- a bias potential provider, which selectively applies a bias potential to at least one of the pressure generating elements not to be driven.

In such a configuration, the non-actuated pressure generating elements are held at the bias potential. Accordingly, the voltage applied to both electrodes of the non-actuated pressure generating elements becomes substantially zero. Hence, power draw is reduced, and a voltage drop stemming from spontaneous discharge of the pressure generating elements becomes smaller. Hence, a power loss is diminished.

Further, occurrence of discharge due to a potential difference between pressure generating elements to be driven and pressure generating elements not to be driven is also reduced. In addition, a further increase in arrangement density of a head can be attained without involvement of an operation for providing insulation between the electrodes of the pressure generating elements.

Preferably, the bias potential is a reference potential of the drive signal.

Preferably, the bias potential provider includes a potential applier which applies the bias potential, and a charger which charges the potential applier with a drive potential of the drive signal.

Here, it is preferable that the charger includes a transistor which applies the drive potential to the potential applier, and a switcher which supplies the drive signal to a base terminal of the transistor during a time period in which the drive signal deactivates the pressure generating elements.

In such a configuration, the transistor is turned on by the supplied drive signal to charge the potential applier with the bias potential.

Here, it is further preferable that the switcher continuously supplies the drive signal before and after a jetting operation is performed.

Specifically, the drive signal is supplied to discharge the potential applier after the jetting operation is performed.

Before the jetting operation, since the potential applier is gradually charged to reach the bias potential by the continuous supply of the drive signal, there is prevented occurrence of faulty operations of respective pressure generating elements, which would otherwise be caused by a sudden increase in the potential of the ground-side electrodes before commencement of the jetting operation.

After the jetting operation, since the potential applier is gradually discharged by the continuous supply of the drive signal, there is prevented occurrence of faulty operations of the respective pressure generating elements, which would otherwise be caused by a sudden drop in the voltage of the ground-side electrodes after completion of the jetting operation.

Further, it is preferable that: the head driver is mounted on the jetting head, and the switcher is embodied by a part of a switching circuit included in the head driver which selectively applies the drive signal to the at least one pressure generating elements to be driven.

In such a configuration, the switcher is provided by utilizing a surplus unused section of an existing switching circuit of the head driver mounted on a jetting head, thereby curtailing the cost of parts. Further, a space to be used for mounting the switcher is not particularly required, thus rendering the apparatus compact.

According to the invention, there is also provided a method of driving a jetting head provided with pressure generating elements, the method comprising steps of:

- generating a drive signal selectively applied to at least one of the pressure generating elements to be driven to eject jetted objects; and
- applying a bias potential from a potential applier to at least one of the pressure generating elements not to be driven.

Preferably, the driving method further comprises a step of charging the potential applier with a drive potential of the drive signal.

Here, it is preferable that the charging step is performed during a time period in which the drive signal deactivates the pressure generating elements.

It is further preferable that the charging step is performed during a time period in which the drive signal deactivates the pressure generating elements.

According to the invention, there is also provided a head driving device, which drives a plurality of pressure generating elements for generating pressure fluctuation in a jetted object contained in each of associated pressure chambers formed in a jetting head of a jetting apparatus to eject the jetted object from each of nozzles communicated with the associated pressure chambers, the head driving device comprising:

a head driver, which generates a drive signal which is selectively applied to at least one of the pressure generating elements to be driven;

a bias potential provider, which applies a bias potential to respective ground-side electrodes of the pressure generating elements; and an IC package, in which the head driver and the bias potential provider are provided.

In such a configuration, the ground-side electrodes of the pressure generating elements are held at the bias potential.

Accordingly, the voltage to be applied across both electrodes of the pressure generating elements is reduced. Therefore, power consumption is diminished, and a voltage drop stemming from spontaneous discharge of the pressure generating elements is small, thereby reducing a power loss.

Further, since the voltage to be applied to the pressure generating elements becomes relatively low, electric discharge stemming from a voltage difference between pressure generating elements to be driven and pressure generating elements not to be driven is also reduced. In addition, a further increase in arrangement density of the pressure generating elements can be attained without involvement of an operation for providing insulation between the electrodes of the pressure generating elements, even when pressure generating elements eventually assume a lower withstand voltage.

Since the head driver and the bias potential provider are provided integrally within an IC package, a reduction in packing, wiring, and connection space can be attained.

Preferably, the bias potential is a reference potential of the drive signal.

In such a configuration, the voltage applied to across electrodes of the pressure generating elements becomes substantially zero. Hence, a voltage drop stemming from spontaneous discharge of the pressure generating elements becomes smaller, thereby reducing a power loss.

Preferably, the head driving device further comprising:

a capacitor, having a capacitance which is sufficiently greater than a total electrostatic capacitance of the pressure generating elements, the capacitor provided with a first terminal which is electrically connected to the ground-side electrodes and a second terminal which is grounded; and a control resistor, which electrically connects the first terminal of the capacitor and the bias potential provider.

In such a configuration, the capacitor is charged with a bias potential output from the bias potential provider by way of the control resistor. In a case where an amplifier is provided in the bias potential provider, since the charging voltage of the capacitor is applied to the pressure generating elements, it is not necessary to provide an amplifier of a high speed operable type. A low-speed, small-capacity amplifier can be used, thereby curtailing cost of such an amplifier.

Due to the existence of the control resistor, the charging and discharged currents substantially do not flow into the amplifier of the bias potential provider, but flow into the condenser. Hence, the amount of heat dissipated by the amplifier is reduced.

Here, it is preferable that the bias potential provider charges the capacitor with a potential according to a data signal inputted to the bias potential provider, so that the charged potential is applied to the ground-side electrodes of the pressure generating elements as the bias potential.

Further, it is preferable that the bias potential provider discharges the capacitor according to a data signal inputted to the bias potential provider, so that the ground-side electrodes of the pressure generating elements are discharged.

In such a configuration, due to the existence of the control resistor, a large discharged electric current does not flow into the bias potential provider, thereby lowering the amount of heat dissipated by e.g., an amplifier of the bias potential provider.

Further, it is preferable that the data signal is inputted to the head driver to generate the drive signal.

In such a configuration, a data signal can be input from a common connection terminal of an IC package constituting the head driver and the bias potential provider. Accordingly, inputting a data signal individually to the head driver and to the bias potential provider is not required, thereby reducing the wiring and connection space.

Further, it is preferable that the head driving device further comprises a temperature detector, which detects a temperature of the jetting head. The data signal corresponds to the bias potential which is determined by the detected temperature.

Alternatively, it is preferable that the number of bits forming the data signal is less than the number of a signal inputted to the head driver to generate the drive signal.

The setting accuracy of the bias potential output from the bias potential provider may be lower than the drive signal of the head driver. In such a case, a D/A converter to be incorporated in the bias potential provider can be embodied by a more compact and less-expensive D/A converter.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described by reference to the accompanying drawings. The embodiments to be described hereinbelow are preferred specific embodiments of the invention, and hence technically-preferable limitations are imposed on the embodiments. However, the scope of the invention is not limited to the embodiments unless the following descriptions include descriptions which particularly specify the invention.

Figure 1:
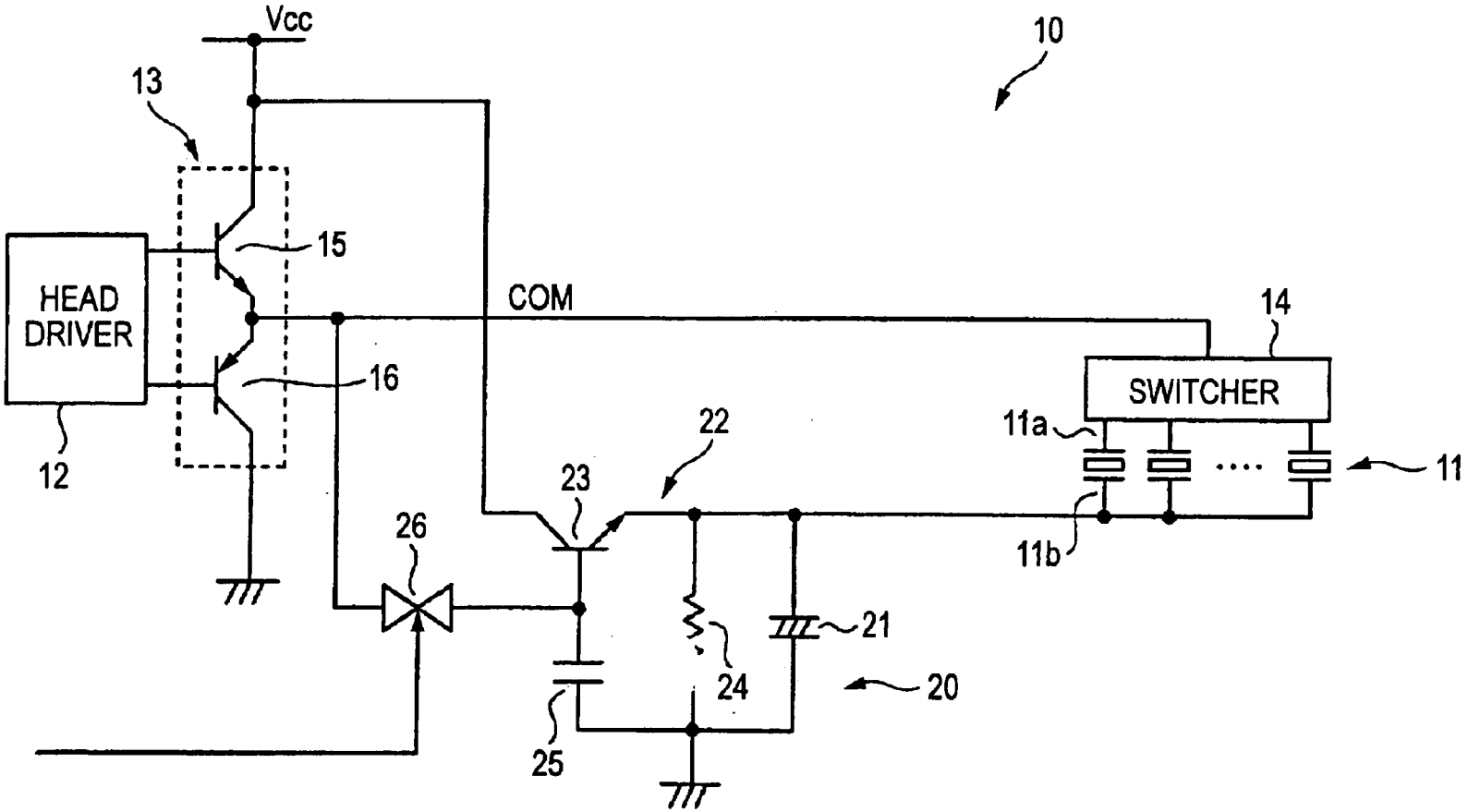
FIG. 1 is a block diagram showing a head driving device according to a first embodiment of the invention.

As shown in FIG. 1, a head driving device 10 according to a first embodiment of the invention comprises: piezoelectric elements 11 provided so as to correspond to a plurality of nozzles of an ink jet printer; a head driver 12 for supplying a drive signal to electrodes 11*a* of the respective piezoelectric elements 11; a current amplifier 13 and a switcher 14, both being interposed between the head driver 12 and the respective piezoelectric elements 11; and a bias potential provider 20 for applying an intermediate potential to ground-side electrodes 11*b* of the piezoelectric elements 11.

A row of nozzles are actually provided on a per-color basis in a print head of the ink jet printer 10, and the piezoelectric elements 11 are provided for each of the rows of nozzles.

The piezoelectric elements 11 are embodied by, e.g., elements exhibiting the piezoelectric effect and formed so as to become displaced by a voltage applied across the electrodes 11*a* and 11*b*.

The piezoelectric elements 11 remain charged in the vicinity of an intermediate potential Vc at all times. The piezoelectric elements 11 are arranged so as to eject ink droplets from nozzles by applying pressure to the ink stored in corresponding nozzles when performing discharging operation in accordance with a drive signal COM output from the head driver 12.

The head driver 12 is embodied as a driver IC and generates a drive signal COM to be sent to the print head which is placed in, e.g., a main unit of the printer.

The current amplifier 13 is formed from two transistors 15, 16. Of the transistors, a collector of the first transistor 15 is connected to a constant voltage power source (e.g., +42V DC power supply), and a base of the same is connected to one output terminal of the head driver 12. Further, an emitter of the first transistor 15 is connected to an input terminal of the switcher 14. As a result, in accordance with a signal output from the head driver 12, a constant voltage Vcc is supplied to the piezoelectric elements 11 via the switcher 14.

An emitter of a second transistor 16 is connected to an input terminal of the switcher 14. A base of the second transistor 16 is connected to a second output terminal of the head driver 12. Further, a collector of the second transistor 16 is connected to ground. As a result, in accordance with a signal output from the head driver 12, the piezoelectric elements 11 are caused to discharge by way of the switcher 14.

Upon receipt of a control signal, the switcher 14 is turned on at a timing at which a corresponding piezoelectric element 11 is to be activated, thereby outputting the drive signal COM to that piezoelectric element 11.

The switcher 14 is, actually formed as a so-called transmission gate for activating or deactivating the respective piezoelectric elements 11.

The bias potential provider 20 is constituted of a capacitor 21 serving as a potential applier, and a charger 22.

The capacitor 21 is an electrolytic capacitor. One end of the capacitor 21 is connected to the ground-side common electrodes 11*b* of the piezoelectric elements 11, and the other end of the capacitor 21 is connected to ground such that a charging voltage of the capacitor; i.e., an intermediate potential Vc, is applied to the grounded elements 11*b* of the respective piezoelectric elements 11.

The capacitance of the capacitor 21 is selected so as to assume sufficient capacitance with respect to a total amount of electrostatic capacitance of all the piezoelectric elements 11 (a total of several microfarads; e.g., approximately 1.4 $\mu$F); that is, hundreds of microfarads to thousands of microfarads, so that the stable intermediate potential can be supplied to the respective piezoelectric elements 11. Here, a device other than a capacitor may be employed as the potential applier.

The charger 22 comprises a transistor 23 serving as a switching element; a resistor 24; a capacitor 25; and an analog switch 26.

An emitter of the transistor 23 is connected to one end of the capacitor 21, and a collector of the same is connected to a constant voltage power supply Vcc.

In lieu of the transistor 23, any of various types of switching elements; for example, an FET, a thyristor, and a TRIAC, may also be employed.

The resistor 24 is connected to a point located between the emitter of the transistor 23 and the ground. The capacitor 25 is connected to a point located between the base of the transistor 23 and the ground.

Further, the analog switch 26 is connected to a point located between the base of the transistor 23, and the emitter of the first transistor 15 and the emitter of the second transistor 16, where the transistors 15, 16 belong to the current amplifier 13.

Upon receipt of an activation/deactivation control signal output from the control section of the printer main unit, the analog switch 26 is activated by, for example, a high-level control signal or deactivated by, for example, a low-level control signal.

The control signal is set so as to be brought to a high level during a non-driving period of the drive signal COM output from the head driver 12 via the current amplifier 13; that is, a period of an intermediate potential, and so as to be brought to a low level during a driving period of the drive signal.

The control signal is set so as to become continuously high at the commencement or end of printing operation.

The head driving device 10 of the embodiment is constructed in the manner set forth and operates in the following manner in accordance with a head driving method of the invention.

First, the operation of the head driving device 10 to be performed at start of printing operation of the ink jet printer (e.g., activation of the ink jet printer) will be described.

At the time of commencement of printing operation, the drive signal COM output from the head driver 12 via the current amplifier 13 increases gradually.

Figure 2:
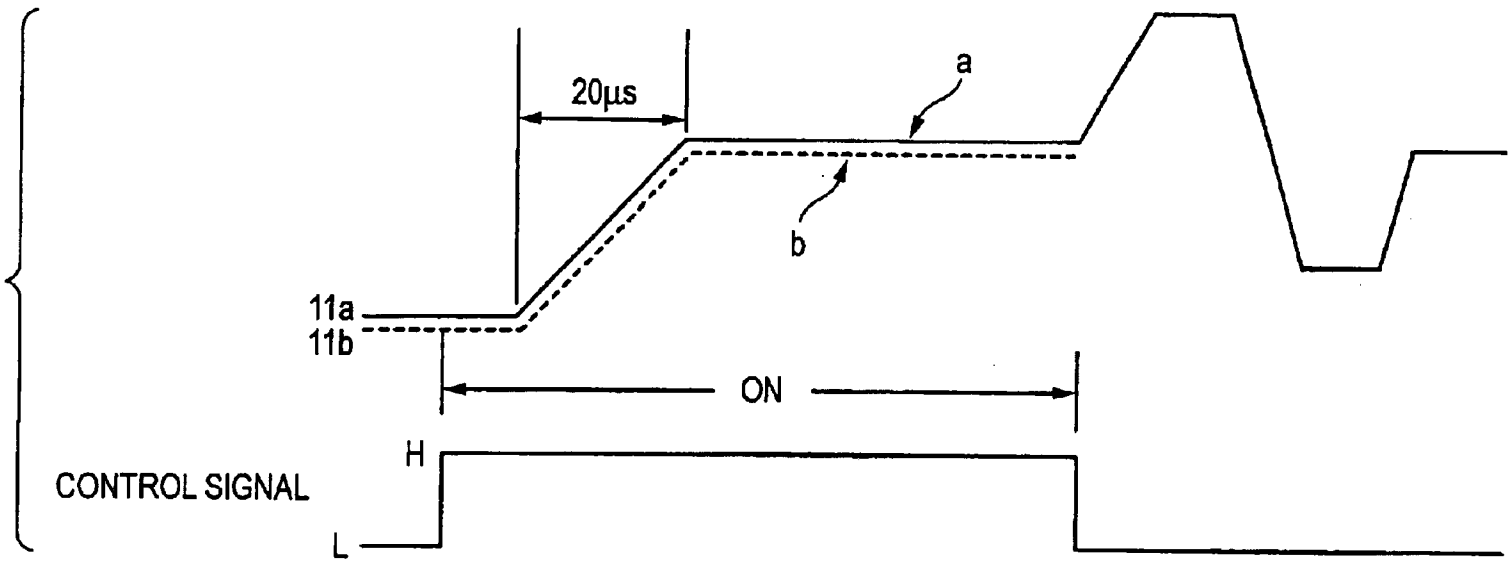
FIG. 2 is a timing chart showing operation of the head driving device to be performed at commencement of printing operation.

As a result, in accordance with the drive signal COM, an electric current flows from the first transistor 15 of the current amplifier 13 to the electrodes 11*a* of the piezoelectric elements 11 via the switcher 14. As indicated by solid line "a" shown in FIG. 2, the electrodes 11*a* of the piezoelectric elements 11 gradually increase in potential up to the intermediate potential Vc; e.g., after a period of 20 μsec.

At this time, as a result of activation of the analog switch 26, the drive signal COM is applied to the base of the transistor 23 of the charger 22, thereby activating the transistor 23.

As a result, a constant voltage output from the constant voltage power supply Vcc is applied to the capacitor 21, thereby gradually charging the capacitor 21. Accordingly, a charging voltage of the capacitor 21 gradually increases up to the intermediate potential Vc. As indicated by dashed lines "b" shown in FIG. 2, the ground-side electrodes 11*b* of the piezoelectric elements 11 also gradually increase in potential, thus reaching the intermediate potential Vc.

In this way, the ground-side electrodes 11*b* of the piezoelectric elements 11 reach the intermediate potential in the same manner as do the electrodes 11*a* to be activated by the drive signal COM. Hence, a potential difference between the electrodes 11*a*, 11*b* of the piezoelectric elements is suppressed to a low level. Accordingly, since the potential difference is lower than the intermediate potential Vc of the drive signal COM, there is prevented ejection of ink droplets, which would otherwise be caused by faulty operation of the piezoelectric elements 11.

Figure 3:
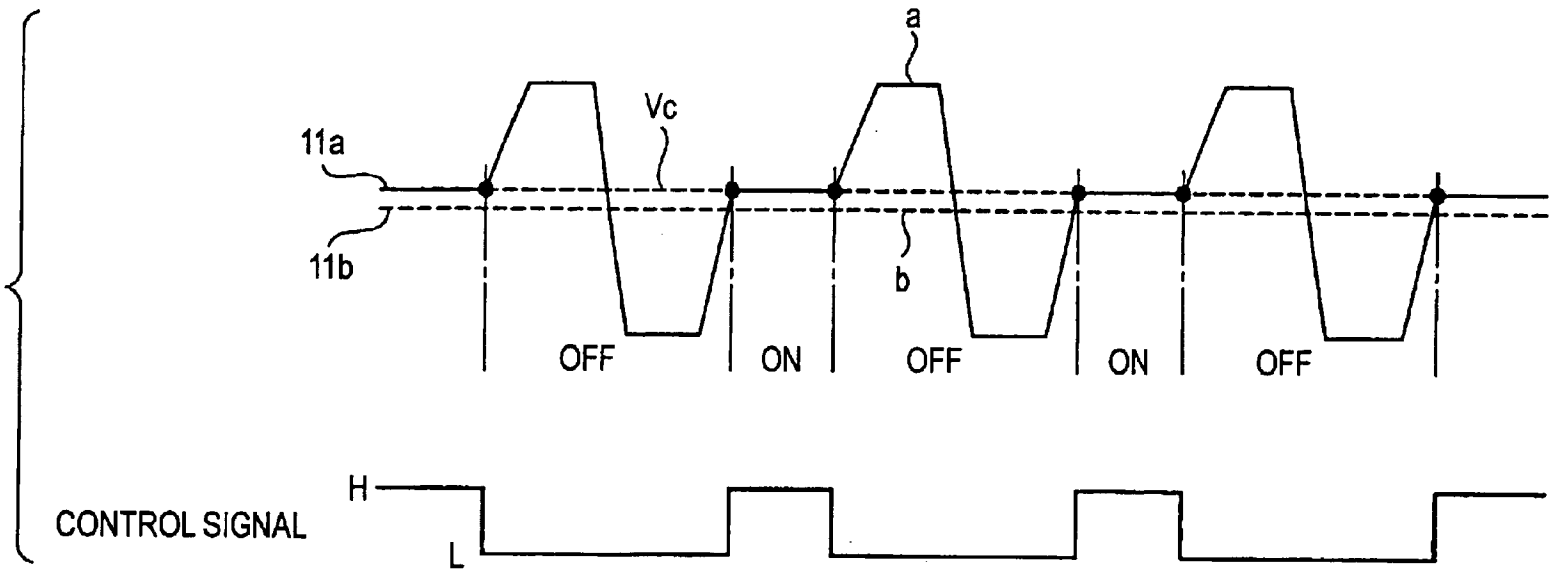
FIG. 3 is a timing chart showing operation of the head driving device to be performed during the course of printing operation.

Operation of the head driving device 10 to be performed during printing operation of the ink jet printer will now be described. As shown in FIG. 3, when the drive signal COM is higher than the intermediate potential, the electrodes 11*a* of the piezoelectric elements 11 are charged by way of the first transistor 15 of the current amplifier 13 in accordance with fluctuations in the drive signal COM. When the drive signal COM is lower than the intermediate potential, the electrodes 11*a* of the piezoelectric elements 11 discharge an electric current via the second transistor 16 of the current amplifier 13. As a result, the piezoelectric elements 11 operate in accordance with the drive signal COM, thereby ejecting ink droplets.

At that time, as shown in FIG. 3, the analog switch 26 is activated only during the non-driving period of the drive signal COM (i.e., when the potential of the drive signal becomes the intermediate potential). Hence, the charger 22 always charges the capacitor 21 of the bias potential provider 20 with the intermediate potential.

As a result, the intermediate potential Vc is applied to the common electrodes 11*b* of the piezoelectric elements 11 from the capacitor 21. Hence, the electrodes 11*b* are always held at the intermediate potential Vc as indicated in dashed lines "b" shown in FIG. 3.

Operation of the head driving device 10 to be performed at the end of the printing operation of the ink jet printer (e.g., when the ink jet printer is deactivated) will now be described.

At the time of completion of printing operation, the drive signal COM to be output from the head driver 12 to the current amplifier 13 is discharged from the electrodes 11*a* of the piezoelectric elements 11 via the second transistor 16 of the current amplifier 13, whereby the electrodes 11*a* fall to zero potential.

At this time, the analog switch 26 is turned on, whereby the drive signal COM is applied to the base of the transistor 23 of the charger 21. However, since the drive signal COM is in the midst of a gradual fall, the transistor 23 remains deactivated.

Figure 4:
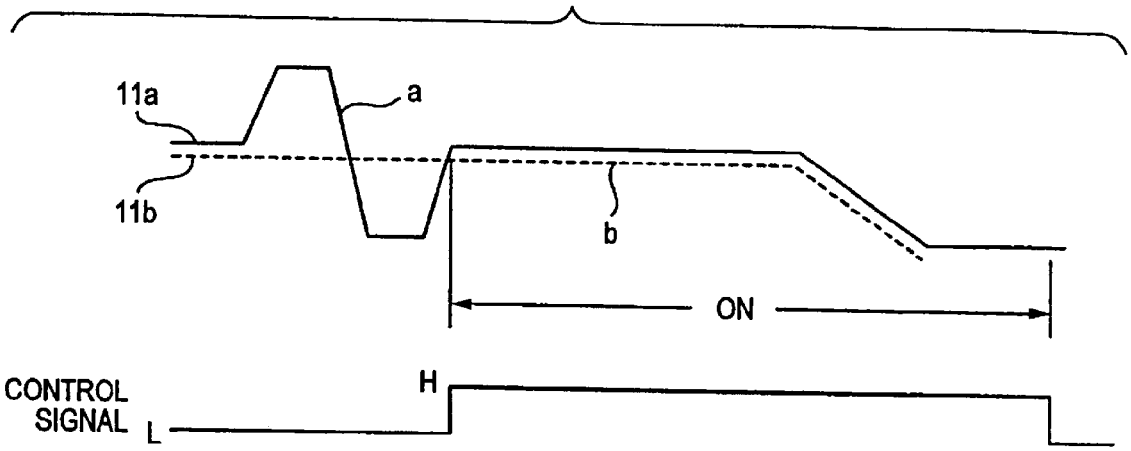
FIG. 4 is a timing chart showing operation of the head driving device to be performed at the end of the printing operation.

The capacitor 21 of the bias potential provider 20 is grounded via the resistor 24. Therefore, the capacitor 21 is gradually discharged. Since the charging voltage of the capacitor 21 falls to zero, the electrodes 11*b* of the piezoelectric elements 11 also gradually fall in potential, as indicated by dashed lines "b" shown in FIG. 4, to thereby reach zero.

The ground-side electrodes 11*b* of the piezoelectric elements 11 gradually reach zero potential as in the case of the electrodes 11*a* to be activated by the drive signal COM. Therefore, a potential difference between the electrodes 11*a*, 11*b* of the piezoelectric elements is suppressed to a low level. Accordingly, the potential difference is lower than the intermediate potential Vc of the drive signal COM, and hence there is prevented ejection of ink droplets, which would otherwise be caused by faulty operation of the piezoelectric elements 11.

In this way, the power to be dissipated by the piezoelectric elements 11 is diminished, and a voltage drop stemming from spontaneous discharge of the piezoelectric elements is small, which in turn reduces a power loss.

A potential difference between the piezoelectric elements 11 to be driven and the piezoelectric elements 11 not to be driven becomes small. Hence, even when these piezoelectric elements 11 are located adjacent to each other, electric discharge arising between the piezoelectric elements 11 is diminished. Moreover, even when the withstand voltage of each of the piezoelectric elements 11 becomes lower as a result of an increase in arrangement density, providing insulation between the piezoelectric elements 11 is unnecessary. Hence, an increase in arrangement density of a head can be achieved easily.

Since the capacitor 21 is charged by utilization of a head drive voltage, a specific power supply circuit to be used for producing the intermediate potential Vc is not required.

Figure 5:
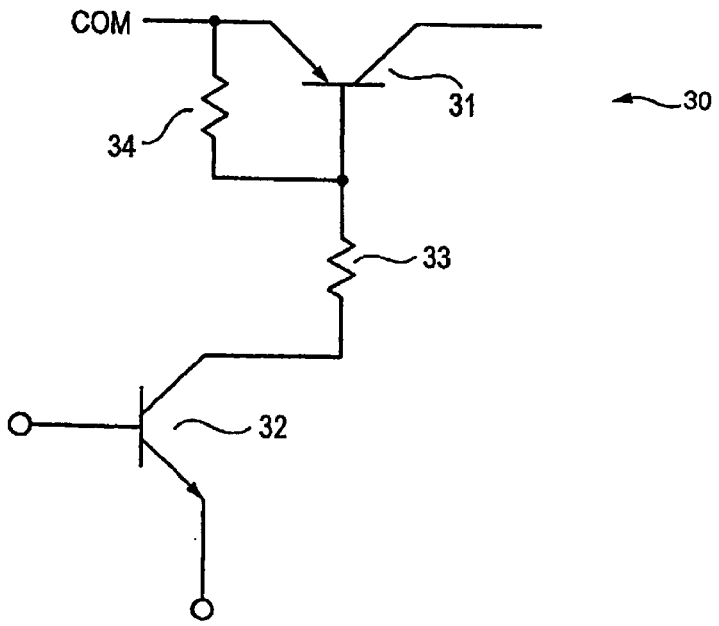
FIG. 5 is a fragmentary circuit diagram showing an exemplary configuration of an analog switch in the head driving device.

FIG. 5 shows an exemplary configuration of a switcher which can be used in place of the analog switch 26.

As shown in FIG. 5, a switcher 30 comprises, in lieu of the analog switch 26, a transistor 31 connected to a point located between the base of the transistor 23, the emitter of the first transistor 15, and the emitter of the second transistor 16, both transistors 15, 16 belonging to the current amplifier 13; and a transistor 32 connected to a point located between the base of the transistor 31 and the ground by way of a resistor 33.

A resistor 34 is connected to the base and emitter of the transistor 31.

An activation/deactivation control signal output from the control section of the printer main unit is input to the base of the transistor 32.

By the switcher 30 of such a configuration, as a result of a high-level control signal being input to the base of the transistor 32, the drive signal COM flows to the ground via the resistors 33, 34, thereby applying a voltage to the base of the transistor 31. Thus, the transistor 31 is activated.

As a result of a low-level control signal being input to the base of the transistor 32, the potential of the base of the transistor 31 and the potential of the emitter of the transistor 31 are held at the same potential, and consequently the transistor 31 is deactivated.

Activation and deactivation of the switcher 30 are controlled by the control signal in the same manner as employed for the analog switch 26.

Figure 6:
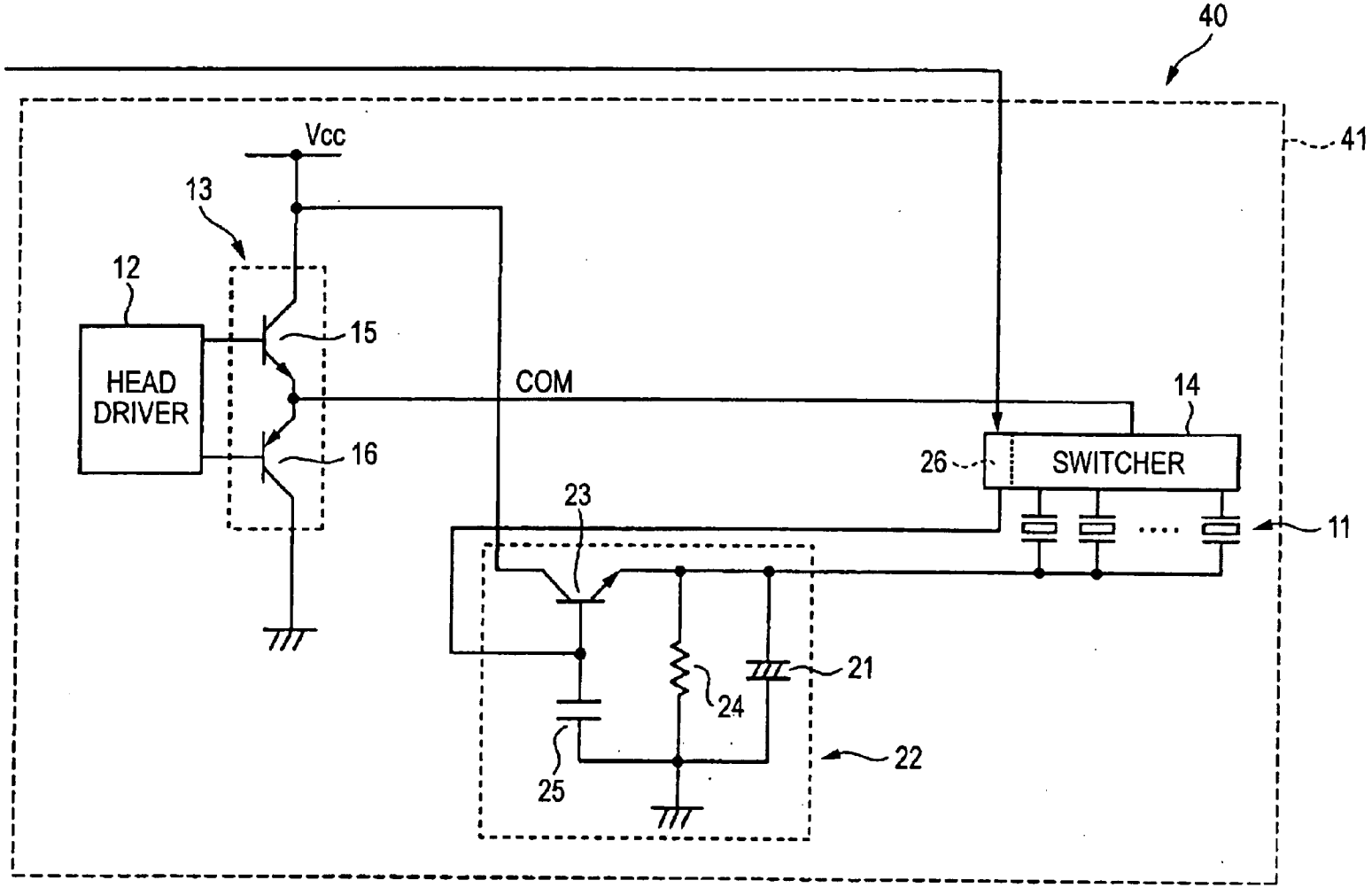
FIG. 6 is a block diagram showing a head driving device according to a second embodiment of the invention.

As shown in FIG. 6, a head driving device 40 according to a second embodiment of the invention is substantially identical in configuration with the head driving device 10 shown in FIG. 1. Those constituent elements which are the same as those of the head driving device 10 are assigned the same reference numerals, and their explanations are omitted.

As in the case of the head driving device 10 shown in FIG. 1, the head driver 12, the current amplifier 13, the switcher 14, and the bias potential provider 20 are mounted on a print head 41 (or a carriage supporting a print head 17).

The analog switch 26 of the bias potential provider 20 is constituted by utilization of an unused switching section of the switcher 14 mounted on the print head 41.

The head driving device 40 of such a configuration operates in the same manner as does the head driving device 10 shown in FIG. 1. Since the analog switch 26 utilizes an unused switch section of the switcher 14, a smaller number of parts are required, whereby the cost of parts and an assembly cost can be reduced.

In the above embodiments, the charger 22 is constituted of the transistor 23, the resistor 24, the capacitor 25, and the analog switch 26. However, the charger is not limited to such a circuit. A charger of another arbitrary configuration can also be used, so long as the circuit can supply a constant voltage from the constant voltage power supply Vcc to the capacitor 21.

Figure 7:
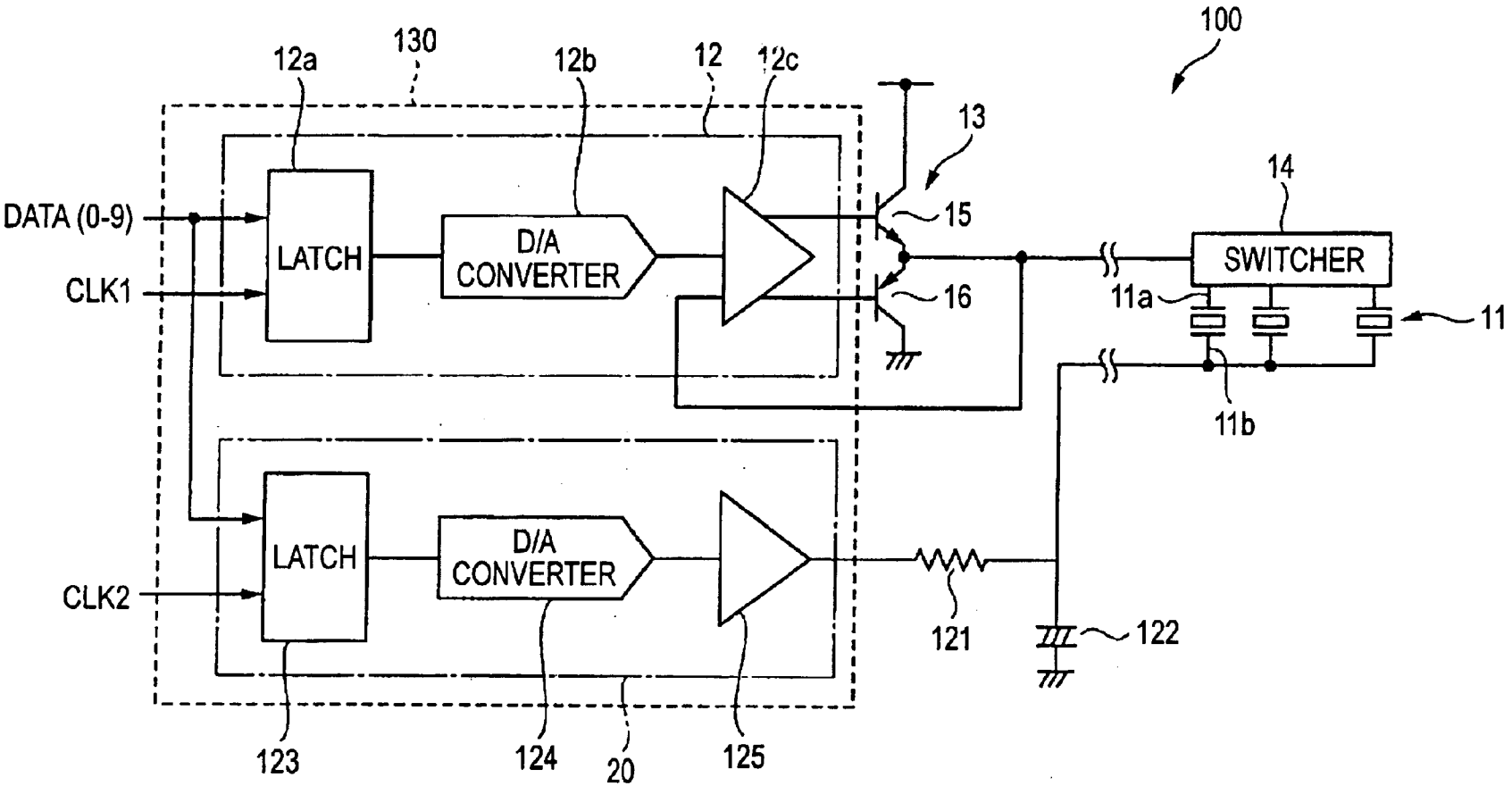
FIG. 7 is a block diagram showing a head driving device according to a third embodiment of the invention.

As shown in FIG. 7, a head driving device 100 according to a third embodiment of the invention comprises: piezoelectric elements 11 provided so as to correspond to a plurality of nozzles of an ink jet printer; a head driver 12 for supplying a drive signal to electrodes 11*a* of the respective piezoelectric elements 11; a current amplifier 13 and a switcher 14, both being interposed between the head driver 12 and the respective piezoelectric elements 11; a bias potential provider 20 for applying a predetermined bias voltage to ground-side electrodes 11*b* of the piezoelectric elements 11; a control resistor 121; and a capacitor 122. Those constituent elements which are the same as those of the head driving devices according to the above embodiments are assigned the same reference numerals, and their explanations are omitted.

The head driver 12 is embodied as a driver IC 130 and generates a drive signal COM to be sent to the print head placed in, e.g., a main unit of the printer.

In this case, the head driver 12 is constituted of a latch 12*a*; a D/A converter 12*b*; and an amplifier 12*c*.

In this embodiment, the latch 12*a* is arranged so as to receive 10-bit data signals DATA0 to DATA9 output from the control section of the printer main unit, and a clock signal is input to a clock terminal CLK1 of the latch 12*a*.

In accordance with the data signals DATA0 to DATA9 input to the D/A converter 12*b* by way of the latch 12*a*, the D/A converter 12*b* outputs an analog signal corresponding to a drive voltage through D/A conversion.

Further, the amplifier 12*c* amplifies the analog signal output from the D/A converter 12*b*, to thereby produce a predetermined drive voltage waveform.

The bias potential provider 20 is formed from a latch 123, a D/A converter 124, and an amplifier 125 in the same manner as is the head driver 12.

In the case of the illustrated embodiment, the latch 123 receives the 10-bit data signals DATA0 to DATA9 output from the control section of the printer main unit of the ink jet printer, and a clock signal is input to a clock terminal CLK2 of the latch 123.

In accordance with the data signals DATA0 to DATA9 input by way of the latch 123, through D/A conversion the D/A converter 124 outputs an analog voltage corresponding to the bias voltage.

Further, the amplifier 125 amplifies an analog voltage output from the D/A converter 124, thus producing a predetermined bias voltage.

The bias potential provider 20 constituted of the latch 123, the D/A converter 124, and the amplifier 125 is housed in the driver IC 130 constituting the head driver 12 and embodied as a single IC package.

Figure 8:
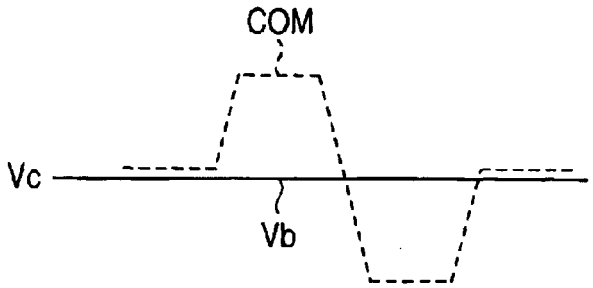
FIG. 8 is a timing chart showing a relationship between a drive signal of a head driver and a bias voltage in the head driving device shown in FIG. 7.

In this way, the bias potential provider 20 outputs, to the ground-side electrodes 11*b* of the piezoelectric elements 11, a predetermined bias voltage Vb, preferably a voltage substantially equal to the intermediate potential Vc of the drive signal COM output from the head driver 12, as shown in FIG. 8.

The control resistor 121 is a so-called coupling resistor and charges the capacitor 122 with the bias voltage Vb output from the bias potential provider 20. At the time of discharging operation of the capacitor 122, the control resistor 121 limits the current discharged from the capacitor 122.

The control resistor 121 is set to hundreds of ohms (e.g., 200 Ω) so as to enable smooth charging of the capacitor 122 and to effectively limit a discharge current.

The capacitor 122 is an electrolytic capacitor. One end of the capacitor 122 is connected to the ground-side common electrodes 11*b* of the piezoelectric elements 11, and the other end of the capacitor 122 is grounded such that a charging voltage of the capacitor; i.e., the bias voltage Vb, is applied to the common electrodes 11*b* of the respective piezoelectric elements 11.

The capacitance of the capacitor 122 is selected so as to assume sufficient capacitance with respect to a total amount of electrostatic capacitance of all the piezoelectric elements 11 (a total of several microfarads; e.g., approximately 1.4 μF); that is, thousands of microfarads (e.g., approximately 3300 μF) so that the stable bias voltage Vb can be supplied to the respective piezoelectric elements 11.

The head driving device 100 of the embodiment is constructed in the manner set forth and operates in the following manner.

First, operation to be performed at the time of activation of the ink jet printer will be described in accordance with a flowchart shown in FIG. 9.

When the ink jet printer is activated, the control section of the printer main unit detects a head temperature (step A1), and calculatively determines an intermediate voltage Vc1 corresponding to the thus-detected temperature (step A2). Incidentally, the temperature detected in the step A1 may be a temperature in the vicinity of the print head, an environmental temperature of the printer, or the like.

Subsequently, the control section of the printer main unit activates all nozzles of the printer head (step A3). In step A4, the control section gradually increases digital values represented by the data signals DATA0 to DATA9 while delivering a clock signal to the clock terminal CLK1, thus controlling the D/A converter of the head driver 12.

Figures 10A, 10B:
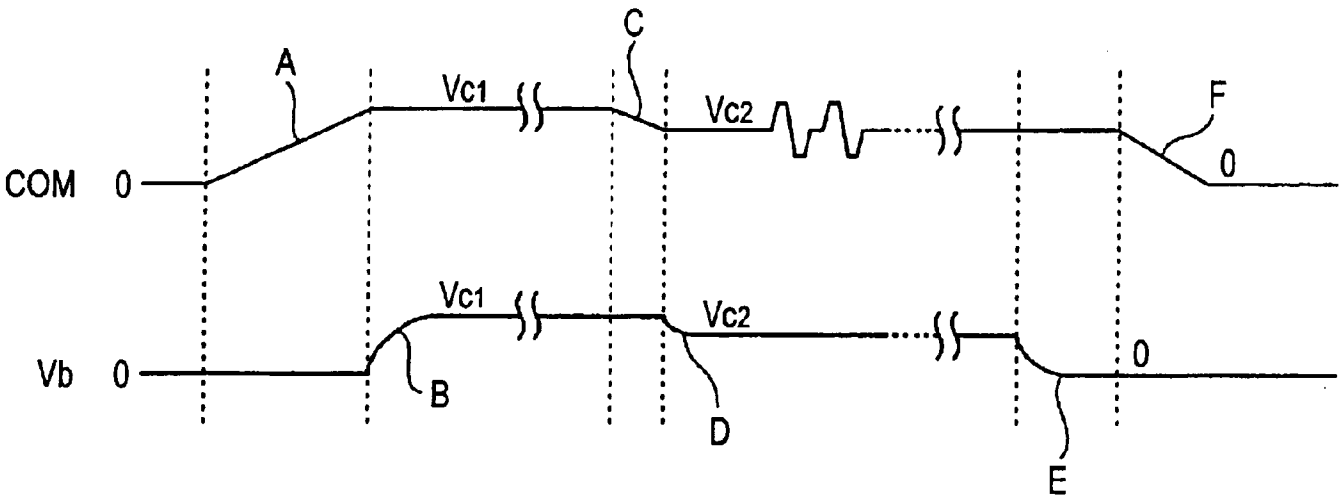
FIG. 10A is a timing chart showing a drive signal of the head driver of the head driving device shown in FIG. 7.
FIG. 10B is a timing chart showing a bias voltage of the bias potential supplier of the head driving device shown in FIG. 7.

As a result, by way of the switcher 14 an electric current flows from the first transistor 15 of the current amplifier 13 in response to the drive signal COM, thereby charging the electrodes 11*a* of the piezoelectric elements 11. As indicated by reference symbol A shown in FIG. 10A, the electrodes 11*a* of the piezoelectric elements 11 increase up to the intermediate potential Vc1.

Subsequently, the control section of the printer main unit outputs a digital value of the intermediate potential Vc1 in the form of the data signals DATA0 to DATA9 (step A5). In step A6, the control section outputs one clock pulse to the CLK2 terminal of the latch 123 of the bias potential provider 20, thereby controlling the D/A converter 124 of the bias potential provider 20.

As a result, the bias potential provider 20 applies a bias voltage Vb (=Vc1) to the capacitor 122 by way of the control resistor 121, thus charging the capacitor 122. The charging voltage of the capacitor 20 gradually increases up to the intermediate potential Vc1 in accordance with a time constant defined by the control resistor 121 and the capacitor 122. As indicated by reference symbol B shown in FIG. 10B, the potential of the ground-side electrodes 11*b* of the piezoelectric elements 11 gradually increases and finally reaches the intermediate potential Vc1. Accordingly, a potential difference between the electrodes 11*a*, 11*b* of the piezoelectric elements becomes substantially zero. At this point, the operation of the printer driver to be performed at the activation is completed.

The bias voltage Vb stored in the capacitor 122 is applied to the ground-side electrodes 11*b* of the piezoelectric elements 11. Hence, the amplifier 125 of the bias potential provider 20 does not need to be a high-speed operable type; an amplifier which outputs a small electric current will be sufficient.

Next, the operation of the head driving device to be performed at the commencement of printing operation will now be described by reference to a flowchart shown in FIG. 11. In accordance with the flowchart shown in FIG. 11, when commencement of printing operation of the ink jet printer is instructed, the control section of the printer main unit detects a temperature (step B1), and calculatively determines an intermediate voltage Vc2 corresponding to the thus-detected temperature (step B2). Incidentally, the temperature detected in the step B1 may be a temperature in the vicinity of the print head, an environmental temperature of the printer, or the like.

Subsequently, the control section of the printer main unit activates all the nozzles of the printer head (step B3). In step B4, the digital value represented by the data signals DATA0 to DATA9 is caused to change gradually. As a result of the clock signal being input to the clock terminal CLK1, the D/A converter 12*b* of the head driver 12 is controlled.

As a result, when Vc1<Vc2, an electric current flows into the electrodes 11*a* of the piezoelectric elements 11 from the first transistor 15 of the current amplifier 13 by way of the switcher 14 in accordance with the drive signal COM, thereby charging the electrodes 11*a*. As indicated by reference symbol C shown in FIG. 10A, the voltage of the electrodes 11*a* reaches the intermediate potential Vc2. When Vc1>Vc2, an electric current is discharged from the electrodes 11*a* of the piezoelectric elements 11 by way of the second transistor 16 of the current amplifier 13, whereby the piezoelectric elements 11 are operated in accordance with the drive signal COM, thus ejecting ink droplets.

Subsequently, the control section of the printer main unit outputs a digital value of the intermediate potential Vc2 in the form of the data signals DATA0 to DATA9 (step B5). In step B6, the control section outputs one clock pulse to a CLK2 terminal of the latch 123 of the bias potential provider 20, thus controlling the D/A converter 124 of the bias potential provider 20.

As a result, the bias potential provider 20 applies the bias voltage Vb (=Vc2) to the capacitor 122 by way of the control resistor 121, thereby charging the capacitor 122. Eventually, a charging voltage of the capacitor 20 gradually changes up to the intermediate voltage Vc2 on the basis of the time constant defined by the control resistor 121 and the capacitor 122. As indicated by reference symbol D shown in FIG. 10B, the potential of the ground-side electrodes 11*b* of the piezoelectric elements 11 also changes gradually, to thereby reach the intermediate potential Vc2. Accordingly, a potential difference between the electrodes 11*a*, 11*b* of the piezoelectric elements becomes substantially zero. At this point, the operation of the head driving device to be performed at the commencement of the printing operation is completed.

When printing operation is performed in this state, the electrodes 11*a* of the piezoelectric elements 11 are charged by way of the first transistor 15 of the current amplifier 13 in accordance with variations in the drive signal COM during a period in which the voltage of the drive signal COM is increasing. During a period in which the voltage of the drive signal COM is decreasing, the electrodes 11*a* of the piezoelectric elements 11 discharge an electric current by way of the second transistor 16 of the current amplifier 13. As a result, the piezoelectric elements 11 operate in accordance with the drive signal COM, thereby ejecting ink droplets.

Next, the operation of the head driving device to be performed at the deactivation will be described in accordance with a flowchart shown in FIG. 12. When the deactivation of the ink jet printer is instructed, the control section of the printer main unit activates all the nozzles of the printer head (step C1). In step C2, the control section sets the data signals DATA0 to DATA9 to zero. In step C3, one clock pulse is provided to the clock terminal CLK2 of the latch 123 of the bias potential provider 20.

As a result, the D/A converter 124 of the bias potential provider 20 outputs an analog signal corresponding to a bias voltage Vb=0. Hence, the amplifier 125 outputs a zero bias voltage.

Eventually, the capacitor 122 is discharged. The electric current discharged from the capacitor 122 is gradually discharged from the bias potential provider 20 to the ground while passing through the control resistor 121. In association with this discharging operation, the potential of the ground-side electrodes 11*b* of the piezoelectric elements 11 also falls to zero as indicated by symbol E shown in FIG. 10B.

Subsequently, after elapse of a preset given period of time required for causing the capacitor 122 to discharge (step C4), the control section of the printer main unit gradually decreases the digital value represented by the data signals DATA0 to DATA9 (step C5). The control section controls the D/A converter of the head driver 12 by inputting a clock signal to the clock terminal CLK1.

As a result, an electric current flows from the electrodes 11*a* of the piezoelectric elements 11 to the ground by way of the switcher 14 and the second transistor 16 of the current amplifier 13. As indicated by reference symbol F shown in FIG. 10A, the potential of the electrodes 11*a* of the piezoelectric elements 11 falls to zero.

As a result of the potential of the electrodes 11*a* of the piezoelectric elements 11 and that of the electrodes 11*b* of the same having dropped to zero, the operation of the head driving device to be performed at the deactivation is completed, and subsequently power is turned off.

In this way, the potential of the ground-side electrodes 11*b* of the respective piezoelectric elements 11 is held at the bias voltage Vb; preferably, the intermediate potential Vc, by the charging voltage of the capacitor 122 supplied from the bias potential provider 20. Hence, the potential difference between the electrodes 11*a*, 11*b* of the piezoelectric elements 11 is held at substantially zero. When piezoelectric elements to be driven and piezoelectric elements not to be driven are located adjacent to each other, a potential difference across the electrodes 11*a* of the piezoelectric elements 11 is also held substantially at zero.

A voltage drop stemming from self-discharge of the piezoelectric elements 11 is small, thereby diminishing a power loss.

A potential difference between the piezoelectric elements 11 to be driven and the piezoelectric elements 11 not to be driven becomes low. Hence, even when these piezoelectric elements 11 are located adjacent to each other, electric discharge arising between the piezoelectric elements 11 is diminished. Moreover, even when the withstand voltage of each of the piezoelectric elements 11 becomes lower as a result of an increase in arrangement density, provision of insulation between the piezoelectric elements 11 is not required. Hence, an increase in arrangement density of a head can be easily achieved.

The bias potential provider 20 is constituted integrally with the head driver 12 as a single driver IC 130. Hence, only a small packing space is required. Moreover, both data signals to be input to the bias potential provider 20 and those to be input to the head driver 12 are 10-bit common data signals. Hence, smaller wiring and connection space is sufficient.

A bias voltage of the bias potential provider 20 is applied to the capacitor 122 by way of the control resistor 121. The amplifier 125 of the bias potential provider 20 does not need to be a high-speed operable type; a low-cost, small-capacity amplifier can be employed.

The electric current discharged from the capacitor 122 is limited by the control resistor 121, thereby preventing flow of a large electric current into the bias potential provider 20. Hence, the amount of heat dissipated by the amplifier 125 of the bias potential provider 20 can be greatly reduced.

In the embodiment, the bias potential provider 20 outputs a bias voltage Vb equal to the intermediate voltage Vc of the drive signal COM output from the head driver 12. However, the bias potential provider 20 may output a bias voltage Vb offset from the intermediate voltage Vc.

In this case, a potential between the electrodes 11*a*, 11*b* of the piezoelectric elements 11 does not become substantially zero. However, when compared with a case where the bias voltage is not employed, the potential difference becomes smaller, thereby reducing power to be consumed by the piezoelectric elements. Moreover, a voltage drop stemming from spontaneous discharge of the piezoelectric elements becomes smaller, thereby reducing a power loss. Occurrence of electric discharge resulting from a potential difference between the piezoelectric elements to be driven and the piezoelectric elements not to be driven is also diminished. Even when the piezoelectric elements are made compact and their withstand voltages become lower, the piezoelectric elements can cope with the drive signal. Hence, the arrangement density of the piezoelectric elements can be made increased further without involvement of an operation for providing insulation between electrodes of the piezoelectric elements.

In the embodiments, the 10-bit data signals DATA0 to DATA9 are input to the bias potential provider 20, as in the case of the head driver 12. However, data signals of smaller bits may also be employed.

In this case, the bias voltage may be in the vicinity of an intermediate voltage of the drive signal. Further, the bias voltage may also be less accurate than the drive signal. Hence, for example, an 8-bit data signal may be employed, so long as the maximum value and resolution of the bias voltage are halved. Accordingly, use of an 8-bit latch 123 and an 8-bit D/A converter 124 leads to cost reduction.

Figure 9:
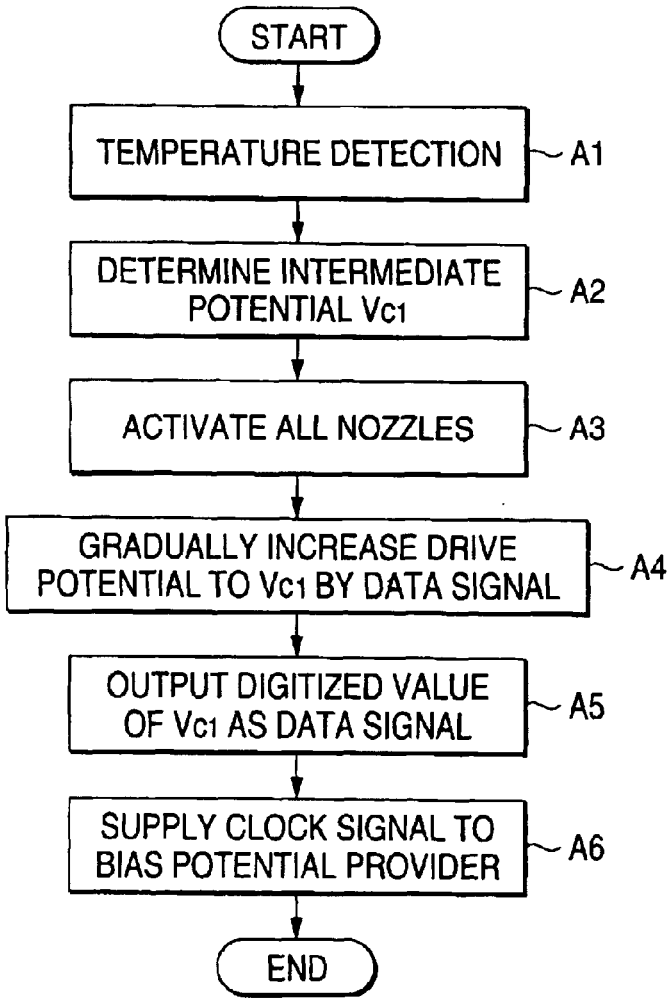
FIG. 9 is a flowchart showing operation of the head driving device shown in FIG. 7 to be performed when the device is activated.
Figure 11:
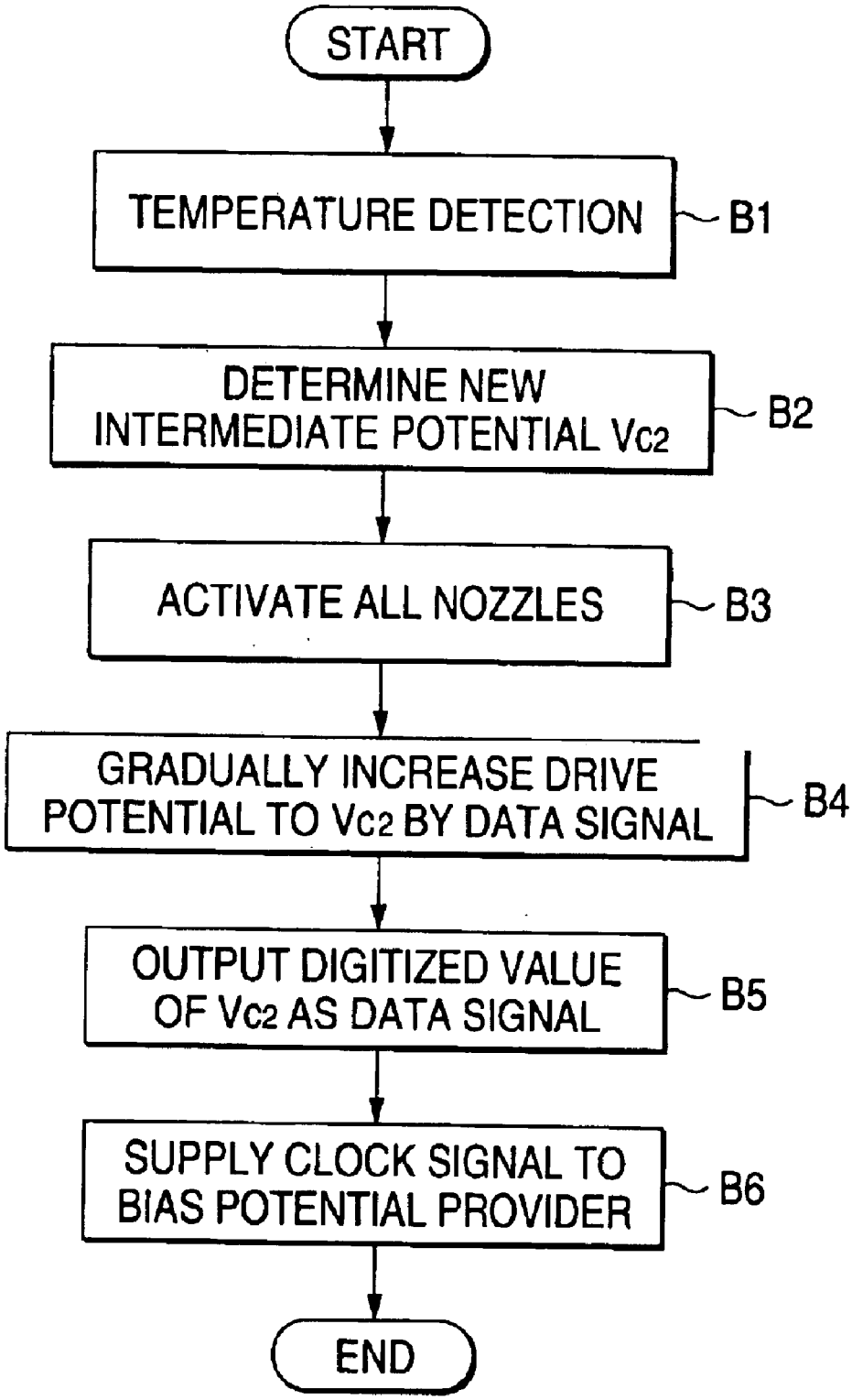
FIG. 11 is a flowchart showing operation of the head driving device shown in FIG. 7 to be performed at commencement of printing operation.
Figure 12:
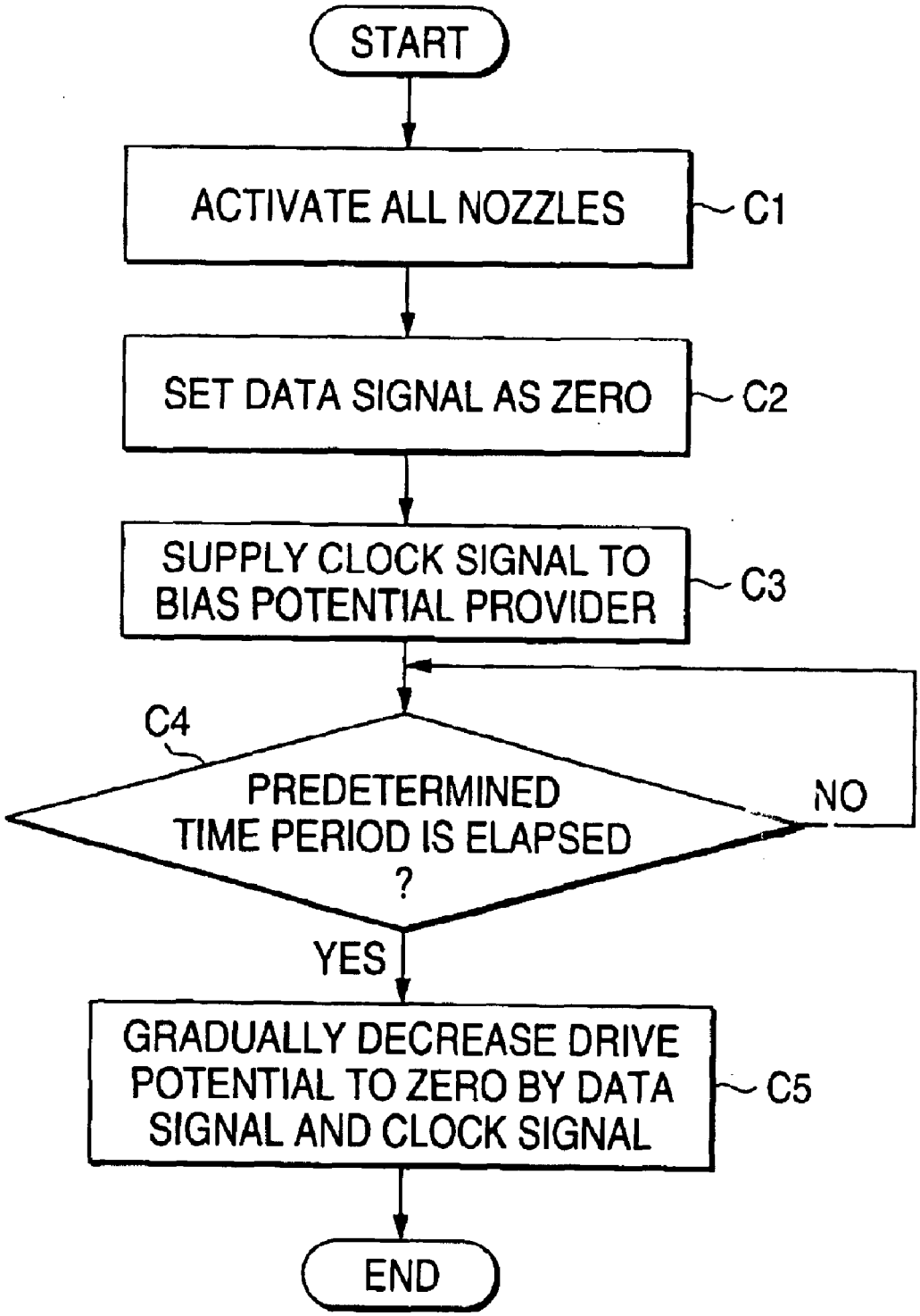
FIG. 12 is a flowchart showing operation of the head driving device shown in FIG. 7 to be performed when the device is deactivated.

Although all the nozzles are turned on in step A3 shown in FIG. 9, in step B3 shown in FIG. 11, and in step C1 shown in FIG. 12, all the nozzles may be deactivated. In this case, substantially no current flows through the two transistors 15, 16 of the current amplifier 13, thus yielding the same result. Moreover, activation or deactivation of the nozzles does not need to be determined. However, in this case, there arises a problem of failure to determine an electric current to flow in a charging/discharging process.

In the above embodiments, the piezoelectric elements 11 are embodied by elements exhibiting the piezoelectric effect. However, other elements; e.g., electrostrictive elements or magnetostrictive elements, may be employed.

The invention can be also applied to display manufacturing apparatuses, electrode forming apparatuses, biochip manufacturing apparatuses, or various types of liquid jetting apparatuses, as well as ink jet printers. Furthermore, the invention can be also applied to a jetting apparatus in which any kinds of gas is selected as a jetted object.

What is claimed is:

1. A head driving device, which drives a plurality of pressure generating elements for generating pressure fluctuation in a jetted object contained in each of associated pressure chambers formed in a jetting head of a jetting apparatus to eject the jetted object from each of nozzles communicated with the associated pressure chambers, the head driving device comprising:

a head driver, which generates a drive signal which is selectively applied to at least one of the pressure generating elements to be driven; and a bias potential provider, which selectively applies a bias potential to at least one of the pressure generating elements not to be driven.

2. The head driving device as set forth in claim 1, wherein the bias potential provider includes a potential applier which applies the bias potential, and a charger which charges the potential applier with a drive potential of the drive signal.

3. The head driving device as set forth in claim 2, wherein the charger includes a transistor which applies the drive potential to the potential applier, and a switcher which supplies the drive signal to a base terminal of the transistor during a time period in which the drive signal deactivates the pressure generating elements.

4. The head driving device as set forth in claim 3, wherein the switcher continuously supplies the drive signal before and after a jetting operation is performed.

5. The head driving device as set forth in claim 3, wherein:

the head driver is mounted on the jetting head; and the switcher is embodied by a part of a switching circuit included in the head driver which selectively applies the drive signal to the at least one pressure generating elements to be driven.

6. The head driving device as set forth in claim 4, wherein the drive signal is supplied to discharge the potential applier after the jetting operation is performed.

7. The head driving device as set forth in claim 1, wherein the bias potential is a reference potential of the drive signal.

8. A head driving device, which drives a plurality of pressure generating elements for generating pressure fluctuation in a jetted object contained in each of associated pressure chambers formed in a jetting head of a jetting apparatus to eject the jetted object from each of nozzles communicated with the associated pressure chambers, the head driving device comprising:

a head driver, which generates a drive signal which is selectively applied to at least one of the pressure generating elements to be driven;

a bias potential provider, which applies a bias potential to respective ground-side electrodes of the pressure generating elements; and an IC package, in which the head driver and the bias potential provider are provided.

9. The head driving device as set forth in claim 8, wherein the bias potential is a reference potential of the drive signal.

10. The head driving device as set forth in claim 8, further comprising:

a capacitor, having a capacitance which is sufficiently greater than a total electrostatic capacitance of the pressure generating elements, the capacitor provided with a first terminal which is electrically connected to the ground-side electrodes and a second terminal which is grounded; and a control resistor, which electrically connects the first terminal of the capacitor and the bias potential provider.

11. The head driving device as set forth in claim 10, wherein the bias potential provider charges the capacitor with a potential according to a data signal inputted to the bias potential provider, so that the charged potential is applied to the ground-side electrodes of the pressure generating elements as the bias potential.

12. The head driving device as set forth in claim 11, wherein the data signal is inputted to the head driver to generate the drive signal.

13. The head driving device as set forth in claim 11, wherein the number of bits forming the data signal is less than the number of a signal inputted to the head driver to generate the drive signal.

14. The head driving device as set forth in claim 10, wherein the bias potential provider discharges the capacitor according to a data signal inputted to the bias potential provider, so that the ground-side electrodes of the pressure generating elements are discharged.

15. The head driving device as set forth in claim 10, further comprising a temperature detector, which detects a temperature of the jetting head, wherein the data signal corresponds to the bias potential which is determined by the detected temperature.

16. A method of driving a jetting head provided with pressure generating elements, the method comprising steps of generating a drive signal selectively applied to at least one of the pressure generating elements to be driven to eject jetted objects; and applying a bias potential from a potential applier to at least one of the pressure generating elements not to be driven.

17. The driving method as set forth in claim 16, further comprising a step of charging the potential applier with a drive potential of the drive signal.

18. The driving method as set forth in claim 17, wherein the charging step is performed during a time period in which the drive signal deactivates the pressure generating elements.

19. The driving method as set forth in claim 18, wherein the charging step is performed before and after a jetting operation is performed.

* * * * *